US007404743B2

(12) United States Patent
Chen et al.

(10) Patent No.: US 7,404,743 B2
(45) Date of Patent: Jul. 29, 2008

(54) CABLE CONNECTOR PLUG HAVING CONTACT WITH HOOKING PORTION

(75) Inventors: Wu-Kuang Chen, Taipei Hsien (TW); Hsiaw-Chiang Chen, Taipei Hsien (TW); Min-Qiang Zhang, Shenzhen (CN); Chang-Hua Liao, Shenzhen (CN); Guo-Zhong Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/672,870

(22) Filed: Feb. 8, 2007

(65) Prior Publication Data

US 2008/0160835 A1 Jul. 3, 2008

(30) Foreign Application Priority Data

Dec. 29, 2006 (CN) ..... 2006 1 0201470

(51) Int. Cl.
*H01R 24/04* (2006.01)

(52) U.S. Cl. ..... 439/669

(58) Field of Classification Search ..... 439/669, 439/668, 733.1, 869, 444
See application file for complete search history.

(56) References Cited

U.S. PATENT DOCUMENTS

| | | | | |
|---|---|---|---|---|
| 4,018,501 | A * | 4/1977 | Maloof | 439/669 |
| 4,630,876 | A * | 12/1986 | Grunberg et al. | 439/293 |
| 5,207,602 | A * | 5/1993 | McMills et al. | 439/836 |
| 6,350,150 | B2 * | 2/2002 | DeLadurantaye, III | 439/502 |
| 6,439,933 | B1 * | 8/2002 | Moji | 439/669 |
| 6,468,104 | B2 * | 10/2002 | Fukase | 439/489 |
| 6,786,774 | B2 * | 9/2004 | Haas et al. | 439/669 |
| 7,066,757 | B1 * | 6/2006 | Rengifo | 439/332 |
| 2002/0098736 | A1 * | 7/2002 | Hattori et al. | 439/587 |
| 2003/0211771 | A1 * | 11/2003 | Sloan | 439/352 |
| 2003/0236018 | A1 * | 12/2003 | Mimoto et al. | 439/357 |
| 2005/0020124 | A1 * | 1/2005 | Nad | 439/470 |
| 2006/0264082 | A1 * | 11/2006 | Kaoh et al. | 439/188 |

* cited by examiner

*Primary Examiner*—T. C. Patel
*Assistant Examiner*—Vladimir Imas

(57) ABSTRACT

An exemplary cable connector plug (20) includes a contact (21) and an insulator (25). The first contact includes a contact portion (210) and an extension portion (211) extending from the contact portion along an axis of the cable connector plug. The first contact further includes a hooking portion (2115) provided at the extension portion. The insulator surrounds the hooking portion, and is lockingly engaged with the hooking portion such that when the extension portion is moved along an axis of the cable connector plug, the first insulator correspondingly moves in unison with the extension portion. The cable connector plug has good mechanical strength and stability.

12 Claims, 5 Drawing Sheets

CABLE CONNECTOR PLUG HAVING CONTACT WITH HOOKING PORTION

CROSS-REFERENCE TO RELATED APPLICATIONS

This application is related to two co-pending U.S. patent applications, application Ser. No. 11/672,862, filed on Feb. 8, 2007, entitled "CABLE CONNECTOR PLUG HAVING CONTACT WITH CURVED EXTENSION PORTION", wherein the inventor is Wu-Kuang Chen et al, and application Ser. No. 11/672,872, filed on Feb. 8, 2007, entitled "CABLE CONNECTOR PLUG HAVING CONTACT WITH ANTI-ROTATION MEMBER", wherein the inventor is Wu-Kuang Chen et al. Such applications have the same assignee as the present application and have been concurrently filed herewith. The disclosures of the above identified applications are incorporated herein by reference.

BACKGROUND OF THE INVENTION

1. Field of the Invention

The present invention relates to electrical connector plugs, and more particularly to a cable connector plug used in a connector for transmitting audio signals or other signals.

2. Discussion of the Related Art

FIG. 5 is a side cross-sectional view of a conventional cable connector plug 10. The cable connector plug 10 includes a first metallic contact 11, a second metallic contact 12, a third metallic contact 13, a fourth metallic contact 14, and a plurality of insulators 15. The metallic contacts 11, 12, 13, 14 are electrical conductors, and are insulated from each other by the insulators 15.

The first contact 11 includes a contact portion 110, an extension portion 111 extending rearwardly from the contact portion 110 along an axis of the cable connector plug 10, and a rear portion 112 extending rearwardly from the extension portion 111. The extension portion 111 includes a first shaft portion 1111, a neck portion 1112, and a second shaft portion 1113. The neck portion 1112 interconnects the first shaft portion 111 and the second shaft portion 1113.

The second and third contacts 12, 13 respectively include an annular contact portion 120, 130, a cylindrical extension portion 121, 131 extending rearwardly from the contact portion 120, 130, and a rear portion 122, 132 extending rearwardly from the extension portion 121, 131. The fourth contact 14 includes a cylindrical contact portion 140, an annular extension portion 141 extending rearwardly from the contact portion 140, and a rear portion 142 extending from the extension portion 141. The extension portions 111, 121, 131, 141 of the first, second, third, and fourth contacts 11, 12, 13, 14 are coaxially arranged in that order from an inside to an outside of the cable connector plug 10. Accordingly, diameters of the extension portions 111, 121, 131, 141 increase in that sequence. The contact portions 110, 120, 130, 140 of the contacts 11, 12, 13, 14 are insulated from each other by a plurality of annular insulating ring portions (not labeled) of the insulators 15. The extension portions 111, 121, 131, 141 of the contacts 11, 12, 13, 14 are insulated from each other by a plurality of cylindrical portions (not labeled) of the insulators 15.

The rear portion 112 of the first contact 11 extends rearwardly beyond the insulators 15 for soldering with a first wire (not shown) of a cable (not shown). A rearmost part of the rear portion 122 of the second contact 12 is exposed for soldering with a second wire (not shown) of the cable. The other part of the rear portion 122 of the second contact 12 is embedded between the corresponding insulators 15. A rearmost part of the rear portion 132 of the third contact 13 is exposed for soldering with a third wire (not shown) of the cable. The other part of the rear portion 132 of the third contact 13 is embedded between the corresponding insulators 15. The rear portion 142 of the fourth contact 14 extends perpendicularly outward from the insulator 15 that is between the third and fourth contacts 13, 14, and is for soldering with a fourth wire (not shown) of the cable.

Generally, a diameter of the first shaft portion 1111 is greater than that of the second shaft portion 1113. A shape of the neck portion 1112 is a conical frustum having an end at the first shaft portion 1111 and an opposite end at the second shaft portion 1113. When the cable connector plug 10 is pulled out of a mating socket (not shown) of a housing (not shown) of a complementary connector (not shown), the first contact 11 is liable to become detached from the adjoining insulator 15. When this happens, the cable connector plug 10 may become loosened or even break apart.

What is needed, therefore, is a new cable connector plug that can overcome the above-described shortcomings.

SUMMARY

A cable connector plug according to a preferred embodiment includes a contact and an insulator. The contact includes a contact portion and an extension portion extending from the contact portion along an axis of the cable connector plug. The extension portion includes a first portion adjacent to the contact portion, a second portion, and a neck portion interconnecting the first portion and the second portion. The extension portion further includes a hooking portion provided at an end of the neck portion where the neck portion connects to the first portion. The insulator surrounds the hooking portion, and is lockingly engaged with the hooking portion such that when the extension portion is moved along a direction coinciding with an axis of the cable connector plug, the first insulator correspondingly moves in unison with the extension portion. A maximum diameter of the hooking portion is greater than a diameter of the first portion where the first portion connects to the neck portion.

Other novel features and advantages will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present cable connector plug. Moreover, in the drawings, like reference numerals designate corresponding parts throughout the several views, and all the views are schematic.

DETAILED DESCRIPTION OF THE PREFERRED EMBODIMENTS

Reference will now be made to the drawings to describe preferred embodiments of the present cable connector plug, in detail.

Figure 1:
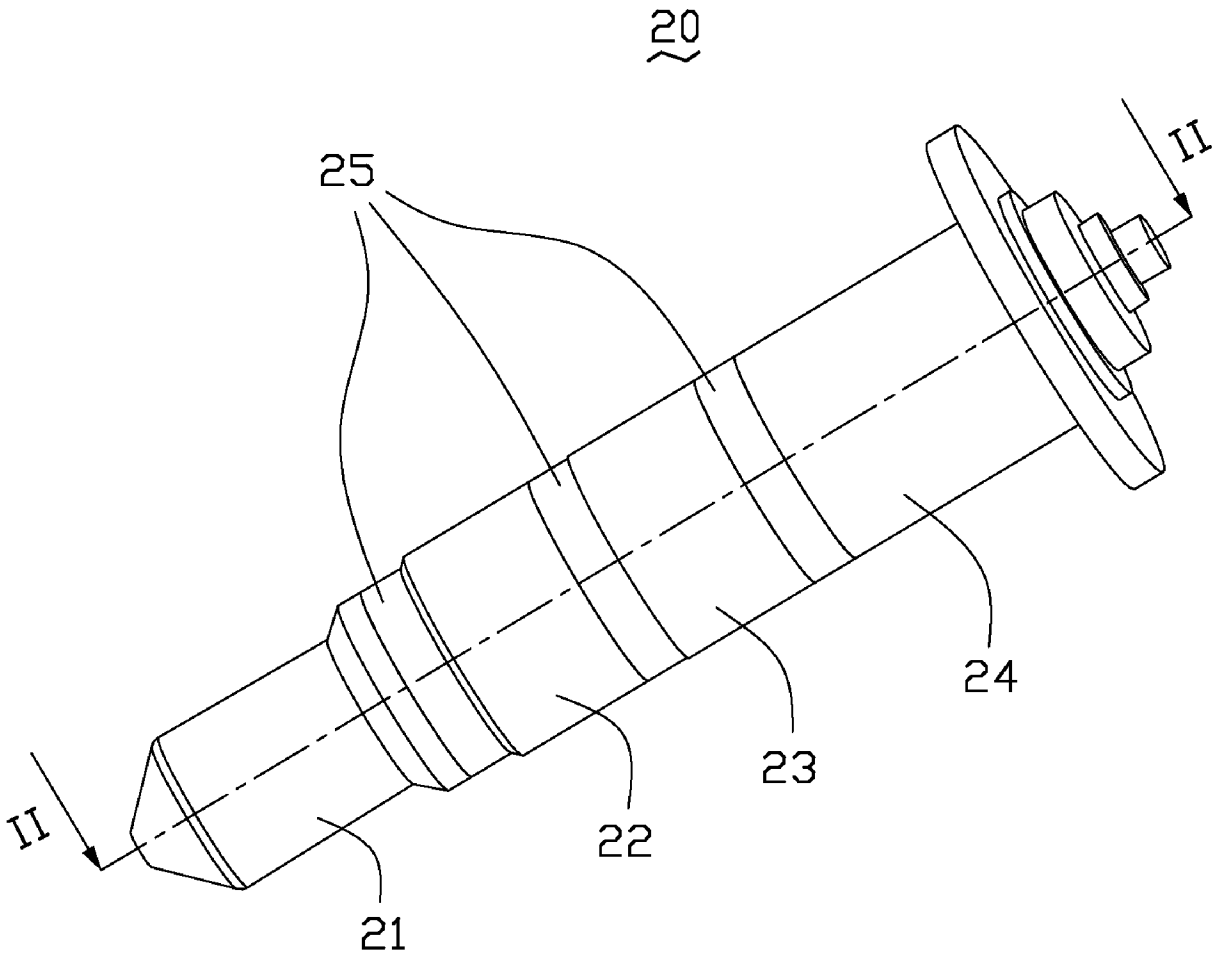
FIG. 1 is an isometric view of a cable connector plug according to a first preferred embodiment of the present invention.
Figure 2:
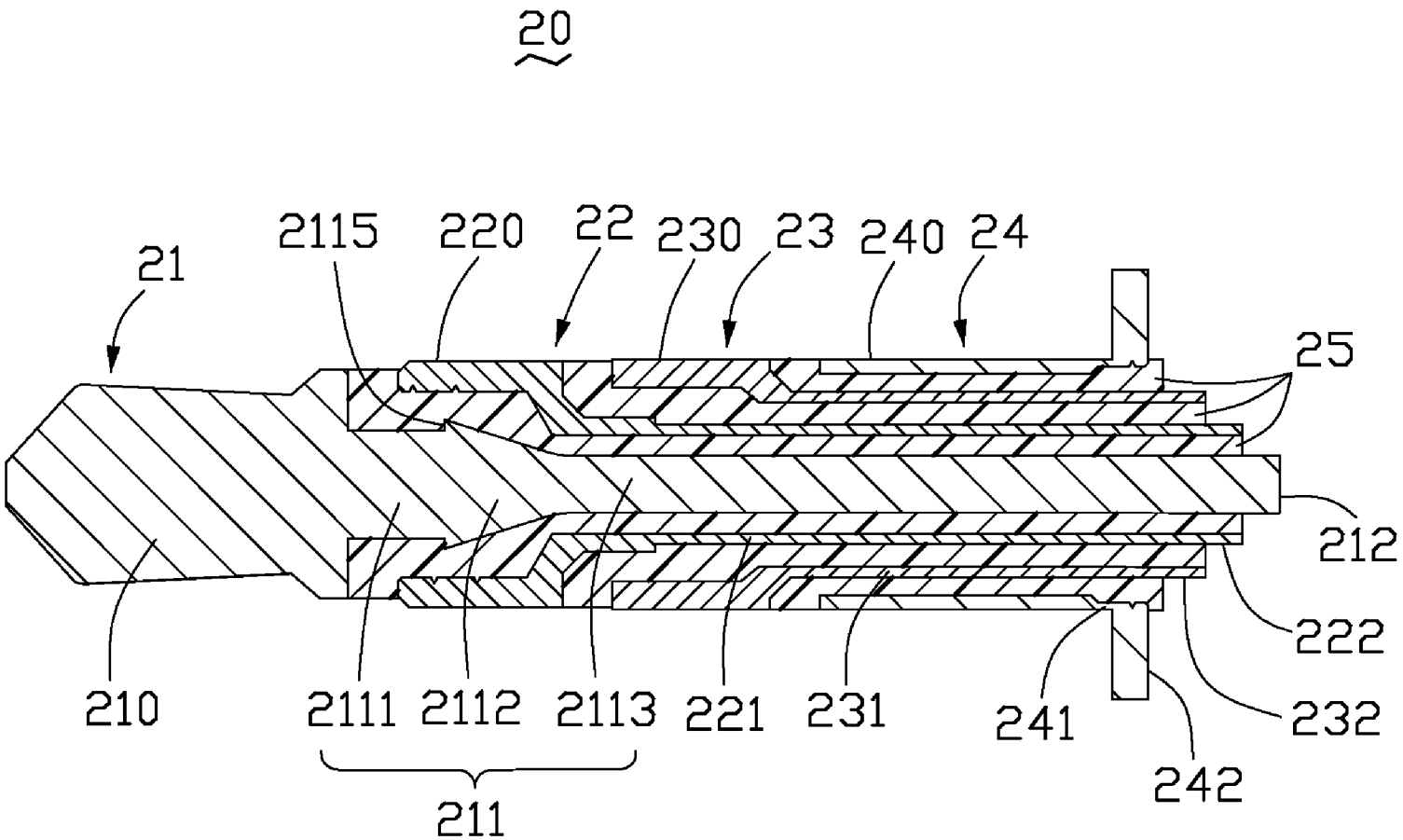
FIG. 2 is a side, cross-sectional view of the cable connector plug of FIG. 1, taken along line II-II thereof.

Referring to FIGS. 1 and 2, a cable connector plug 20 according to a first preferred embodiment of the present invention is shown. The cable connector plug 20 includes a first contact 21, a second contact 22, a third contact 23, a fourth contact 24, and a plurality of insulators 25. The contacts 21, 22, 23, 24 are made of metallic material, and are insulated from each other by the insulators 25. The first contact 21 includes a contact portion 210, an extension portion 211 extending rearwardly from the contact portion 210 along an axis of the cable connector plug 20, and a rear portion 212 extending rearwardly from the extension portion 211. The extension portion 211 includes a first shaft portion 2111, a neck portion 2112, and a second shaft portion 2113.

The second and third contacts 22, 23 respectively include an annular contact portion 220, 230, a cylindrical extension portion 221, 231 extending rearwardly from the contact portion 220, 230, and a rear portion 222, 232 extending rearwardly from the extension portion 221, 231. The fourth contact 24 includes a cylindrical contact portion 240, an annular extension portion 241 extending rearwardly from the contact portion 240, and a rear portion 242 extending from the extension portion 241. The extension portions 211, 221, 231, 241 of the first, second, third, and fourth contacts 21, 22, 23, 24 are coaxially arranged in that order from an inside to an outside of the cable connector plug 20. Accordingly, diameters of the extension portions 211, 221, 231, 241 increase in that sequence. The contact portions 210, 220, 230, 240 of the contacts 21, 22, 23, 24 are insulated from each other by a plurality of ring portions (not labeled) of the insulators 25. The extension portions 211, 221, 231, 241 of the contacts 21, 22, 23, 24 are insulated from each other by a plurality of cylindrical portions (not labeled) of the insulators 25.

The rear portion 212 of the first contact 21 extends rearwardly beyond the insulators 25 for soldering with a first wire (not shown) of a cable (not shown). A rearmost part of the rear portion 222 of the second contact 22 is exposed for soldering with a second wire (not shown) of the cable. The other part of the rear portion 222 of the second contact 22 is embedded between the corresponding insulators 25. A rearmost part of the rear portion 232 of the third contact 23 is exposed for soldering with a third wire (not shown) of the cable. The other part of the rear portion 232 of the third contact 23 is embedded between the corresponding insulators 25. The rear portion 242 of the fourth contact 24 extends perpendicularly outward from the insulator 25 that is between the third and fourth contacts 23, 24, and is for soldering with a fourth wire (not shown) of the cable.

The cable connector plug 20 can be manufactured by way of insert molding. In a typical process, firstly, the contacts 21, 22, 23, 24 are manufactured by a machining method. Secondly, the cable connector plug 20 is integrally assembled by an insert molding method. In particular, the contacts 21, 22, 23, 24 are coaxially aligned in a mold. Molten insulating material is injected into the mold and fills spaces between the contacts 21, 22, 23, 24. The cooled insulating material forms the insulators 25 of the cable connector plug 20.

The first and second shaft portions 2111, 2113 of the cable connector plug 20 are both cylindrical. The neck portion 2112 is a conical frustum that interconnects the first shaft portion 2111 and the second shaft portion 2113. A diameter of the first shaft portion 2111 is greater than that of the second shaft portion 2113. The neck portion 2112 includes a larger circular end at the first shaft portion 2111, and a smaller circular end at the second shaft portion 2113. A diameter of the larger circular end of the neck portion 2112 is greater than that of the first shaft portion 2111. Accordingly, the neck portion 2112 at the first shaft portion 2111 defines a hooking portion 2115. The hooking portion 2115 is generally in the form of an annular step. The adjoining insulator 25 that is between the first and second contacts 21, 22 closely surrounds and contacts the hooking portion 2115 and the first shaft portion 2111 at the hooking portion 2115.

When the cable connector plug 20 is pulled out of a mating socket of a housing of a complementary connector, the hooking portion 2115 helps to prevent shearing occurring as between the extension portion 211 of the first contact 21 and the adjoining insulator 25. Therefore, the first contact 21 avoids becoming detached from the adjoining insulator 15. That is, the cable connector plug 10 has good mechanical strength and stability, and avoids becoming loosened or breaking apart.

The contacts 21, 22, 23, 24 are made of metallic material having good electrical conductive capability, such as copper, aluminum, and so on. In order to ensure good electrical contact and attain an aesthetically pleasing surface, an anticorrosion coating can be formed on an outer surface of each of the contacts 21, 22, 23, 24. The anticorrosion coating is preferably made of nickel. The insulators 25 are preferably made of polyamide resin.

In an alternative embodiment, the first and second shaft portions 2111, 2113 of the extension portion 211 can instead be rectangular columns, and the neck portion 2112 interconnecting the first and second shaft portions 2111, 2113 can be a four-sided pyramidal frustum. For example, the first and second shaft portions 2111, 2113 can be square columns, and the neck portion 2112 can be a square pyramidal frustum. In other alternative embodiments, the first and second shaft portions 2111, 2113 can be polygonal columns, and the neck portion 2112 can be a polygonal pyramidal frustum. In all embodiments, the first and second shaft portions 2111, 2113 can have any desired axial length.

Figure 3:
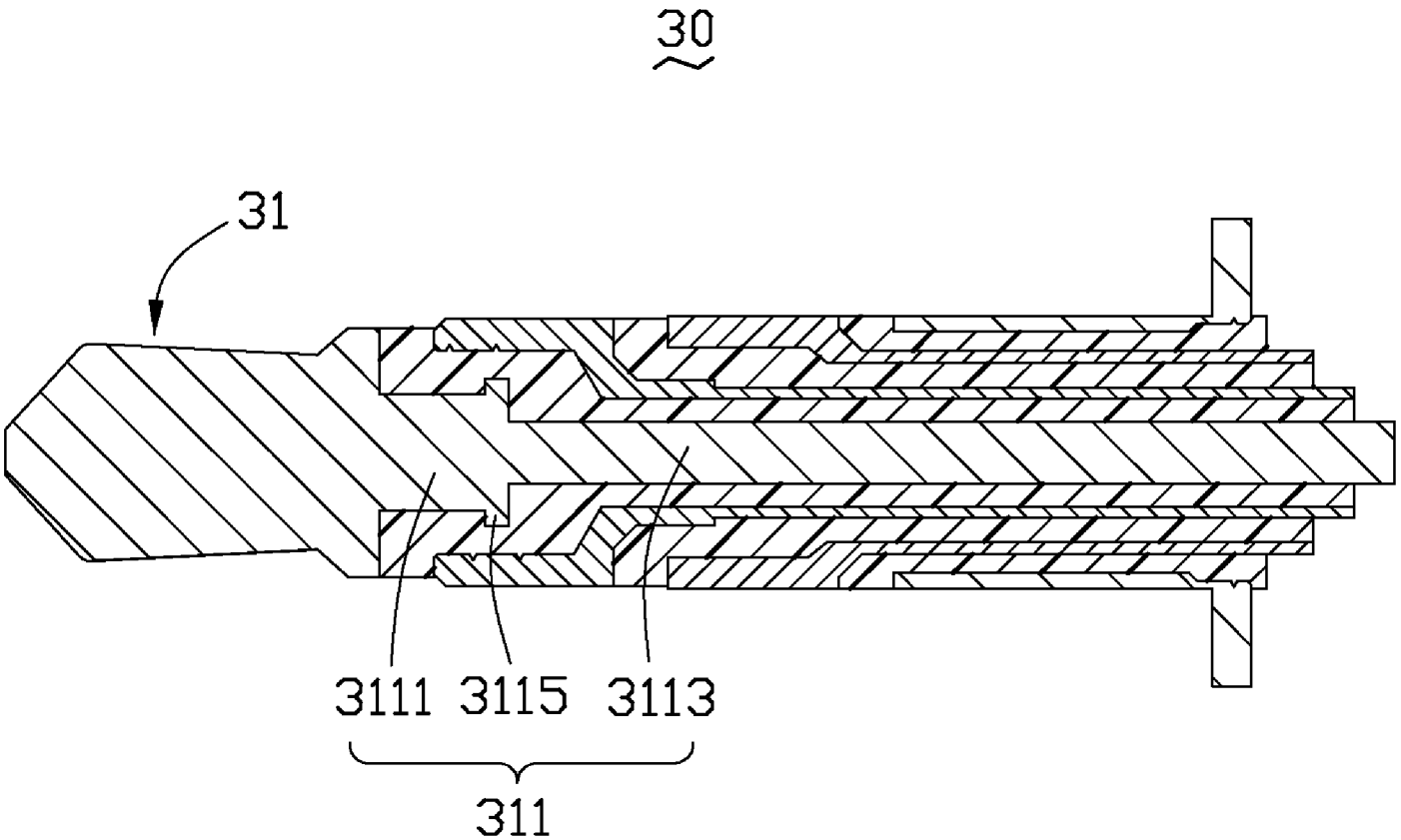
FIG. 3 is a side, cross-sectional view of a cable connector plug according to a second preferred embodiment of the present invention.

Referring to FIG. 3, a cable connector plug 30 according to a second preferred embodiment of the present invention is shown. The cable connector plug 30 is similar in principle to the cable connector plug 20 of the first embodiment. However, the cable connector plug 30 includes of a first contact 31 having an extension portion 311. The extension portion 311 includes a first shaft portion 3111, and a second shaft portion 3113 connecting with the first shaft portion 3111. A diameter of the first shaft portion 3111 is greater than that of the second shaft portion 3112. The extension portion 311 further includes a hooking portion 3115 at an end of the first shaft portion 3111 where the first shaft portion 3111 connects with the second shaft portion 3113. The hooking portion 3115 extends perpendicularly outward from a periphery of the end of the first shaft portion 3111.

In this embodiment, the hooking portion 3115 is an annular flange or an annular bead. Accordingly, a diameter of the hooking portion 3115 is greater than that of the first shaft portion 3111. When the cable connector plug 30 is pulled out of a mating socket of a housing of a complementary connector, the hooking portion 3115 helps to prevent shearing occurring as between the extension portion 311 of the first contact 31 and the adjoining insulator (not labeled). Therefore, the first contact 31 avoids becoming detached from the adjoining insulator. That is, the cable connector plug 30 has good mechanical strength and stability, and avoids becoming loosened or breaking apart. In one alternative embodiment, the diameter of the first shaft portion 3111 and the second shaft portion 3112 can be the same.

Figure 4:
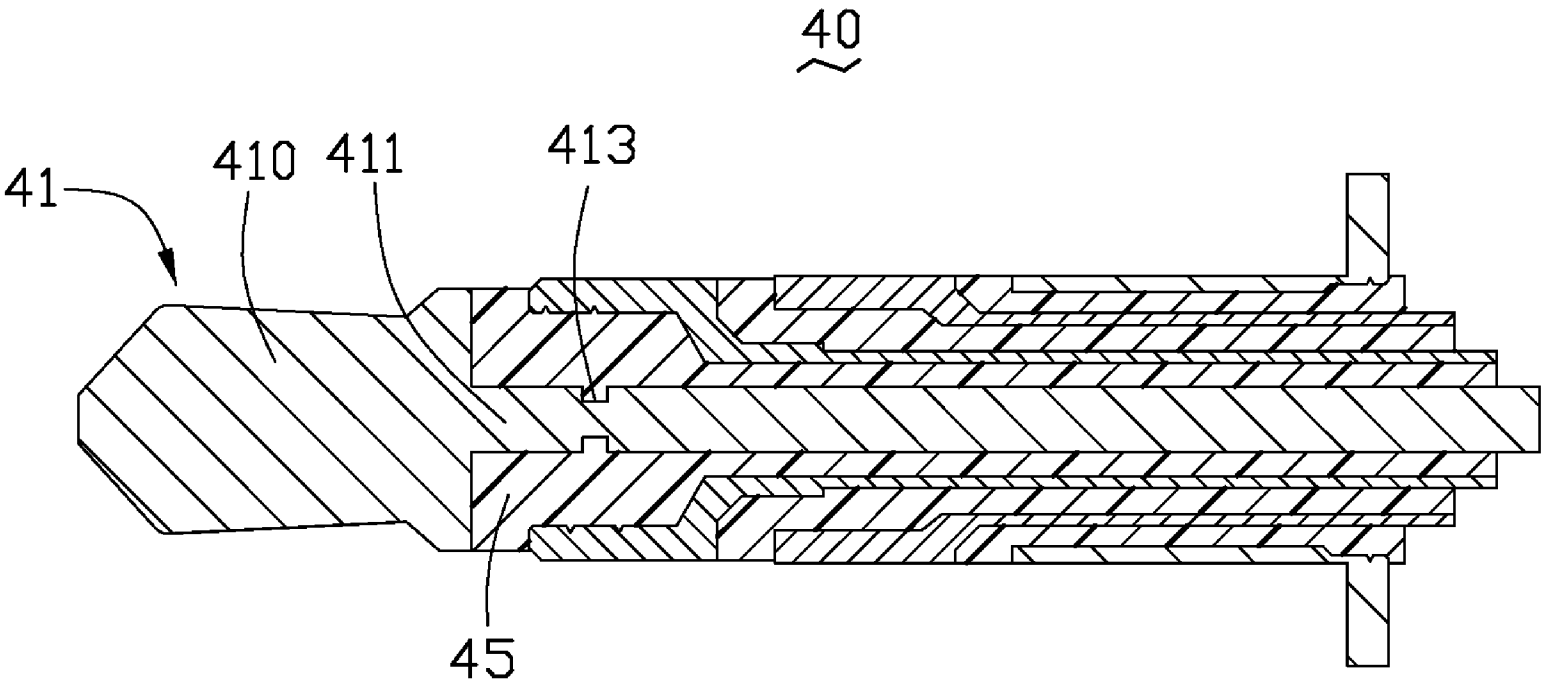
FIG. 4 is a side, cross-sectional view of a cable connector plug according to a third preferred embodiment of the present invention.
Figure 5:
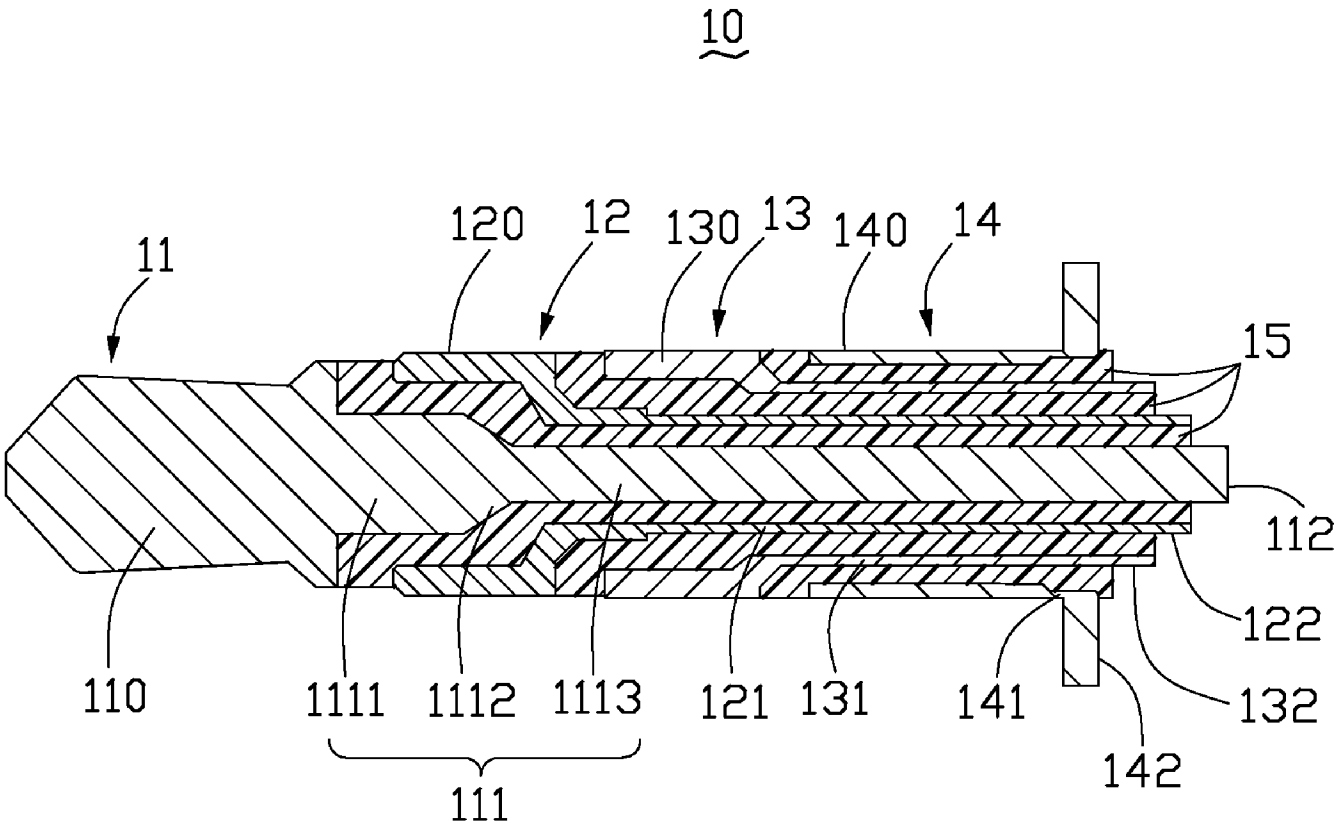
FIG. 5 (RELATED ART)
FIG. 5 is a side, cross-sectional view of a conventional cable connector plug.

Referring to FIG. 4, a cable connector plug 40 according to a third preferred embodiment of the present invention is shown. The cable connector plug 40 is similar in principle to the cable connector plug 20 of the first embodiment. However, the cable connector plug 40 includes a first contact 41. The first contact 41 includes a contact portion 410, a columnar extension portion 411 extending rearwardly from the contact portion 410 along an axis of the cable connector plug 40, and a hooking portion 413 defined at a part of the extension portion 411 near the contact portion 410. In this embodiment, the hooking portion 413 includes an annular groove defined in the extension portion 411. An adjoining insulator 45 closely surrounds and contacts the extension portion 411 including in the annular groove of the hooking portion 413. When the cable connector plug 40 is pulled out of a mating socket of a housing of a complementary connector, the hooking portion 413 helps to prevent shearing occurring as between the extension portion 411 of the first contact 41 and the adjoining insulator 45. Therefore, the first contact 41 avoids becoming detached from the adjoining insulator 45. That is, the cable connector plug 40 has good mechanical strength and stability, and avoids becoming loosened or breaking apart.

It is should be noted that in alternative embodiments, the hooking portion can be provided adjacent to the contact portion of the first contact. For example, in the cable connector plug 40 of the third preferred embodiment, the annular groove can be defined adjacent to the contact portion 410 of the first contact 41. This kind of configuration can similarly help to prevent shearing occurring as between the extension portion 411 of the first contact 41 and the adjoining insulator 45, when the first contact 41 is pulled out of a mating socket of a housing of a complementary connector along a direction coinciding with an axis of the cable connector plug 40.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector plug, comprising:

a contact and an insulator, the contact comprising:

a contact portion; and an extension portion extending from the contact portion along an axis of the cable connector plug, the extension portion including a first portion adjacent to the contact portion, a second portion, and a neck portion interconnecting the first portion and the second portion; and a hooking portion provided at an end of the neck portion of where the neck portion connects to the first portion, the insulator surrounding the hooking portion and lockingly engaged with the hooking portion such that when the extension portion is moved along a direction coinciding with an axis of the cable connector plug, the insulator correspondingly moves in unison with the extension portion, wherein a maximum diameter of the hooking portion greater than a diameter of the first portion where the first portion connects to the neck portion.

2. The cable connector plug according to claim 1, wherein each of the first portion and the second portion has a shape selected from the group consisting of a round cylinder, a round column, a rectangular column, a square column, and a polygonal column.

3. The cable connector plug according to claim 1, wherein the neck portion comprises a larger end where the neck portion connects with the first portion, and a smaller end where the neck portion connects with the second portion, and the neck portion has a shape selected from the group consisting of a conical frustum, a four-sided pyramidal frustum, and a polygonal pyramidal frustum.

4. The cable connector plug according to claim 1, wherein the insulator is made of polyamide resin.

5. The cable connector plug according to claim 1, wherein the contact is made of metallic material.

6. The cable connector plug according to claim 1, further comprising an anticorrosion coating deposited on an outer surface of the contact.

7. The cable connector plug according to claim 6, wherein the anticorrosion coating is made of nickel.

8. A cable connector plug, comprising:

a contact and an insulator, the contact comprising:

a contact portion; and an extension portion extending from the contact portion along an axis of the cable connector plug, the extension portion including a first portion adjacent to the contact portion, a second portion, and a neck portion interconnecting the first portion and the second portion; and a hooking portion provided at an end of the neck portion where the neck portion connects to the first portion, wherein a maximum diameter of the hooking portion is greater than a diameter of the first portion where the first portion connects to the neck portion, and the insulator is abuttingly engaged with the hooking portion such that the extension portion cannot move relative to the insulator along an axial direction of the cable connector plug.

9. The cable connector plug according to claim 8, wherein the neck portion comprises a larger end where the neck portion connects with the first portion, and a smaller end where the neck portion connects with the second portion, and the neck portion has a shape selected from the group consisting of a conical frustum, a four-side pyramidal frustum, and a polygonal pyramidal frustum.

10. A cable connector plug, comprising:

a first contact, a second contact, and an insulator, the first and second contacts being insulated from each other by the insulator, the first contact comprising:

a contact portion; and an extension portion extending from the contact portion along an axis of the cable connector plug, the extension portion comprising a first portion, and a second portion connecting with the first portion; and a hooking portion provided at the extension portion, wherein the hooking portion extends outward from a periphery of the first portion where the first portion connects with the second portion, a maximum diameter of the hooking portion is greater than a diameter of the first portion where the first portion connects with the second portion, and the insulator is abuttingly engaged with the hooking portion such that the extension portion cannot move relative to the insulator along an axial direction of the cable connector plug.

11. The cable connector plug according to claim 10, further comprising a second contact having an annular contact portion, a cylindrical extension portion extending rearwardly from the contact portion, and a rear portion extending rearwardly from the extension portion, wherein the extension portion of the second contact is arranged at an outside of the extension portion of the first contact and coaxial with the first contact, a diameter of the extension portion of the second contact is greater than that of the extension portion of the first contact, the contact portions of the first and second contacts are insulated from each other by an annular ring portion of the insulator, and the extension portions of the first and second contacts are insulated from each other by a cylindrical portion of the insulator.

12. The cable connector plug according to claim 10, wherein the hooking portion is an annular flange or bead.

* * * * *